US005113973A

United States Patent [19]

Southern

[11] Patent Number: 5,113,973

[45] Date of Patent: May 19, 1992

[54] ADJUSTABLE STAND-OFF BRACE FOR A LADDER

[76] Inventor: Don L. Southern, 1918 Euharlee Rd., Kingston, Ga. 30145-2502

[21] Appl. No.: 505,838

[22] Filed: Apr. 6, 1990

[51] Int. Cl.[5] ..... E06C 7/48

[52] U.S. Cl. ..... 182/214; 182/107

[58] Field of Search ..... 182/214, 107, 108, 109, 182/110, 111; 248/210

[56] References Cited

U.S. PATENT DOCUMENTS

| | | | |
|---|---|---|---|
| 1,570,576 | 1/1926 | Rivitz | 182/111 |
| 2,327,317 | 8/1943 | Randall | 182/214 |
| 2,597,902 | 5/1952 | Roketa | 182/214 |
| 3,288,249 | 11/1966 | Gibson | 182/214 |
| 3,693,756 | 9/1972 | Walker | 182/111 |
| 3,708,080 | 1/1973 | Schlei | 182/214 |
| 3,780,828 | 12/1973 | Overturf | 182/111 |
| 4,369,860 | 1/1983 | Beane | 182/214 |
| 4,440,263 | 4/1984 | Smith | 182/214 |
| 4,502,566 | 3/1985 | Wing | 182/214 |

*Primary Examiner*—Reinaldo P. Machado
*Attorney, Agent, or Firm*—John L. James

[57] ABSTRACT

A stand-off brace for attachment to the top end of a ladder maintains the top end of the ladder away from the work surface against which it would ordinarily rest. The brace has a general U-shape wherein the legs are adjustable to vary the distance between the ladder and the work surface. The distance between the legs is also adjustable so that the brace spans the work surface.

1 Claim, 2 Drawing Sheets

ADJUSTABLE STAND-OFF BRACE FOR A LADDER

TECHNICAL FIELD

This invention generally relates to ladders, and, more particularly to ladder attachments for positioning the ladder away from the work surface, and for increasing the effective width of the ladder to prevent the ladder from resting on doors or windows.

BACKGROUND OF THE INVENTION

A ladder is used to help people reach places they would not ordinarily be able to reach. Ladders are often used to climb onto roofs of buildings and are used when washing window or painting. In normal use, the bottom portion of the ladder rests on the ground or other surface, and the top end of the ladder typically leans against the building or work surface. The ladder is oriented at an angle which makes it easy for a user to climb up and down the ladder, and also aids in keeping the ladder from slipping.

One problem with ladders, especially when painting or cleaning the exterior of a house, is that there is an amount of lateral instability because the ladder rests on the side of the house with the only contact with the house being a small portion of the siderails of the ladder. When a person on the ladder reaches outside the rails, one rail will sometimes disengage the work surface, or both rails may slide along the work surface, creating an unstable condition. Accordingly, it will be appreciated that it would be highly desirable to have a ladder that has lateral stability under normal working conditions.

Another problem with typical ladders is that the siderails of the ladder rest on the work surface with a very small contact area which sometimes dents, scrapes or bruises the work surface. It is desirable to have a ladder that contacts the work surface with a broad surface area that does not dent, scrape or mar the work surface.

Another difficulty with ladders is that their width is very narrow when compared to their length which increase the probability of lateral instability. Accordingly, it will be appreciated that it would be highly desirable to have a ladder that has a large lateral dimension too improve lateral stability.

SUMMARY OF THE INVENTION

The present invention is directed to overcoming one or more of the problems set forth above. Briefly summarized, according to one aspect of the present invention, an attachment for a ladder having first and second siderails, comprises an elongated bar having first and second end portions and a middle portion extending between the end portions with the first and second end portions angularly extending from the middle portion. A first resilient pad is pivotally connected to the first end portion of the bar. A second resilient pad is pivotally connected to the second end portion of the bar.

According to another aspect of the present invention an attachment for a ladder having first and second siderails comprises a first member having a rail portion and an end portion angularly extending from the rail portion, a second member having a rail portion and an end portion angularly extending from the rail portion, and a third member extending between said first and second members. The first and second members engage the third member and are slidably moveable relative to the third member and to one another to vary the distance between said end portions of the first and second members. The third member is attached to the siderails of the ladder.

It is an object of the present invention to provide ladder which effectively increases the lateral dimension of the ladder to improve lateral stability of the ladder.

Another object of the invention is to provide an attachment for a ladder to improve the lateral stability of the ladder.

Another object of the invention is to provide a ladder attachment that is adjustable to span various width of a work surface.

Still another object of the invention is to provide a non-slip gripping portion for a ladder that grips the work surface without damaging the work surface.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 1:
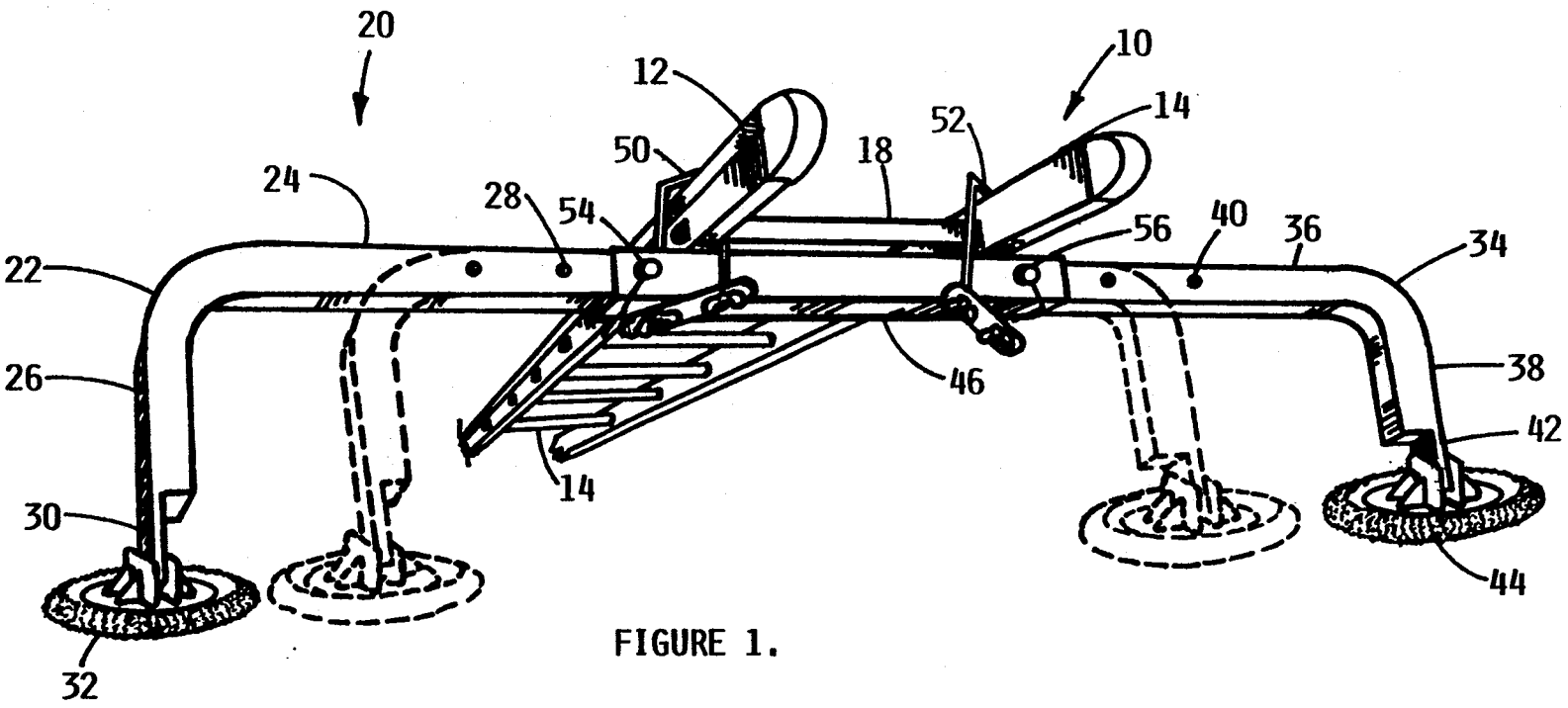
FIG. 1 is an isometric view of a preferred embodiment of a ladder with a stand-off brace attached in accordance with the present invention, and illustrating the adjustability of the stand-off brace.

Referring to FIG. 1, a ladder 10 has first and second siderails 12, 14, and a plurality of rungs 16, including a top rung 18, extending at spaced intervals between the siderails 12, 14. In the ladder 10, the length of the rungs 14, 18 is fixed and thereby fixes the width of the ladder 10. The width of the ladder 10 typically ranges from about ten to about twenty inches, while the length ranges from about ten to about forty feet or more. Thus, the ladder 10 is very long compared to its width.

A stand-off brace 20 is attached to the ladder 10. The stand-off brace 20 is preferably constructed of hollow aluminum or steel, or other strong, durable material, and conveniently has a round or rectangular cross section. The stand-off brace 20 includes a first member 22 that has a rail portion 24 and an end portion 26 angularly extending from the rail portion 24. Preferably, the end portion 26 extends from the rail portion 24 at a right angle. The transition from the rail portion 24 to the end portion 26 may be an abrupt angular change, or, more preferably, may be a curved transition. The rail portion 24 may have one or a plurality of holes 28 therein. The end portion 26 preferably includes means, such as a narrow section with a bore 30, for pivotally connecting a resilient pad assembly 32. Such a resilient pad assembly is described in detail in U.S. Pat. No. 4,754,842, which issued to the present inventor on Jul. 5, 1988, and is incorporated herein by reference.

The stand-off brace 20 includes a second member 34 that has a rail portion 36 and an end portion 38 angularly extending from the rail portion 36. Preferably, the end portion 38 extends from the rail portion 36 at a right angle. The transition from the rail portion 36 to the end portion 38 may be an abrupt angular change, or, more preferably, may be a curved transition. The rail portion 36 may have one or a plurality of holes 40 therein. The end portion 38 preferably includes means, such as a narrow section with a bore 42, for pivotally connecting a resilient pad assembly 44.

The stand-off brace 20 includes a third member 46 that has a plurality of openings 48. The third member 46 is connected to the siderails 12, 14 of the ladder 10 by attaching means, such as U-bolts 50, 52. Preferably, the third member 46 is attached to the rails 12, 14 by the U-bolts 50, 52 in the vicinity of the top rung 18 of the ladder 10. By this construction, the third member 46 may remain attached to the ladder 10 without interfering with the operation of the ladder 10 in the case of an extension ladder 10 wherein attachments sometimes interfere with extension and retraction.

Still referring to FIG. 1, the first member 22 fits into one end of the third member 46 and is slidably movable therein between a first position at which the resilient pad 32 is spaced a first, preselected maximum distance from the first siderail 12, and a second position at which the resilient pad 32 is spaced a second, preselected minimum distance from the first siderail 12 (shown in phantom in FIG. 1). The first is member 22 is fixed in position relative to the third member 46 by aligning openings 28, 48 and inserting a bolt or pin 54 therein.

Similarly, the second member 34 fits into the other end of the third member 46 and is slidably movable therein between a first position at which the resilient pad 44 is spaced a first, preselected maximum distance from the second siderail 14, and a second position at which the resilient pad 44 is spaced a second, preselected minimum distance from the second siderail 14 (shown in phantom in FIG. 1). The second is member 34 is fixed in position relative to the third member 46 by aligning openings 40, 48 and inserting a bolt or pin 56 therein.

Preferably, the brace 20 is adjusted so that the first resilient pad 32 is spaced from the first siderail 12 the same distance that the second resilient pad 44 is spaced from the second siderail 14. This equal spacing of the pad 32, 44 from the siderails 12, 14 maintains the symmetry of the ladder 10 and, more importantly, improves lateral stability of the ladder 10. The first and second members 22, 34 may be removed from the third member 46 for transport or storage.

Figure 3:
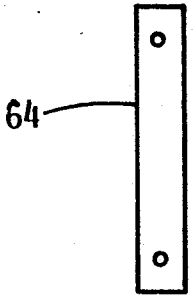
FIG. 3 is a diagrammatic view similar to FIG. 2, but illustrating another embodiment.
Figure 2:
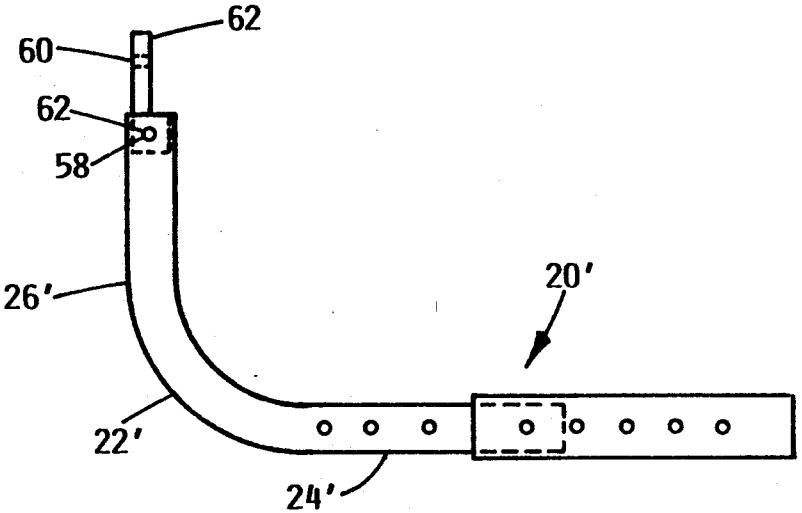
FIG. 2 is a somewhat enlarged, partial diagrammatic view of a stand-off brace similar to the stand-off brace of FIG. 1, but illustrating another embodiment.

Referring to FIG. 2, another embodiment of the stand-off brace 20' is illustrated wherein the first member 22' has a rail portion 24' and an end portion 26'. The end portion 26' has an opening 58 near its distal end. A plug 60 also has an opening 62 and is slidable into the distal end of the end portion 26' so that the openings 58, 62 are aligned. A bolt or pin may be inserted through the aligned openings 58, 62 to secure the end plug 63 to the end portion 26'. The end plug 60 has a reduced cross section portion 62 for pivotally connecting to a resilient pad assembly. The end plug 60 may be solid or hollow. Also, the end plug 60 may have a very short length to operate merely as a plug and attachment and connecting means for the resilient pad. Alternatively, the end plug 60 may be longer to act as an extension to farther stand off the brace 20' from the work surface. Further, the end plug 60 may be used in conjunction with an extension arm 64 (FIG. 3) wherein one end of the extension arm 64 fits into the distal end of the end portion 26', and the plug 60 then fits into the other end of the extension arm 64.

Figure 5:
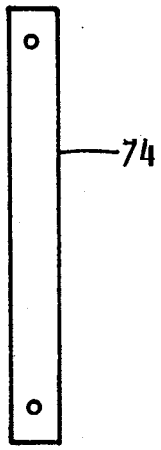
FIG. 5 is a diagrammatic view similar to FIG. 3, but illustrating another embodiment.
Figure 4:
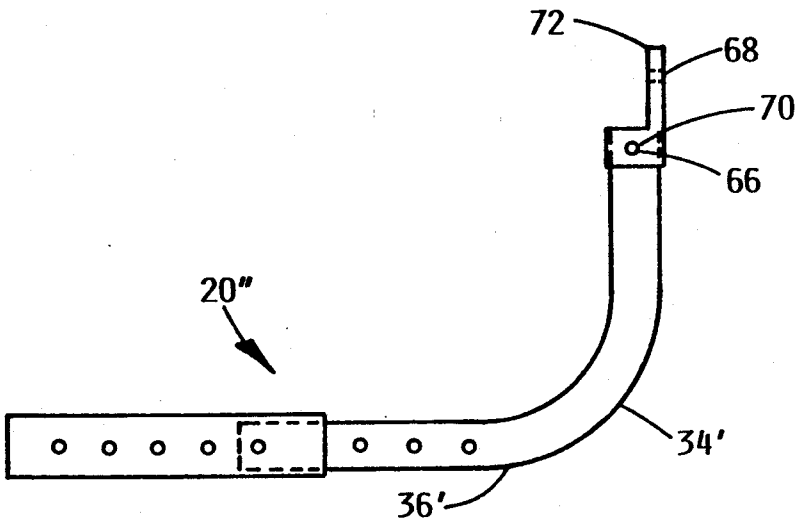
FIG. 4 is diagrammatic view of the stand-off brace similar to FIG. 2, but illustrating another embodiment.

Referring to FIG. 4, another embodiment of the stand-off brace 20'' is illustrated wherein the second member 34' has a rail portion 36' and an end portion 38'. The end portion 38' preferably has an opening 66 near its distal end. A cap 68 also has an opening 70 and is slidable over the distal end of the end portion 38' so that the openings 66, 70 are aligned. A bolt or pin may be inserted through the aligned openings 66, 70 to secure the end cap 68 to the end portion 38'. The end cap 68 has a reduced cross section portion 72 for pivotally connecting to a resilient pad assembly. The end cap 68 may have a very short length to operate merely as a cap and attachment and connecting means for the resilient pad. Alternatively, the end cap 68 may be longer to act as an extension to farther stand off the brace 20'' from the work surface. The end cap 68 may be primarily hollow with internal shoulders, or may be primarily solid with hollow portions. Further, the end cap 68 may be used in conjunction with an extension arm 72 (FIG. 5) wherein one end of the extension arm 72 fits over the distal end of the end portion 38', and the cap 68 then fits over the other end of the extension arm 72.

While operation of the present invention is believed to be apparent from the foregoing description, a few words will be added for emphasis. The third member 46 of the brace 20 is attached to the ladder 10 with the U-bolts 50, 52. The pads 32, 44 are attached to the first and second members 22, 34 which are then inserted into the third member 46. The distance between the pad 32, 44 is adjusted by aligning the holes 28, 40, 48 at the width desired and fixing the position with the pins 54, 56. It is anticipated that the width will be adjusted from time to time which is handy when painting or washing windows. While extending the width to the maximum and leaving it there permanently is good for ladder stability, it is easier to handle a ladder with lesser widths. Extensions 64, 74 may be used to increase the distance the ladder stands away from the work surface.

It will be now appreciated that there has been presented a an attachment for a ladder to improve the lateral stability of the ladder. The ladder attachment is adjustable to span various widths of a work surface. The ladder attachment effectively increases the lateral dimension of the ladder to improve lateral stability of the ladder under all conditions. The ladder contacts the work surface with a broad surface area that does not dent, scrape or mar the work surface. A non-slip gripping portion of a ladder attachment engages the work surface without damaging the work surface.

While the invention has been described with particular reference to a preferred embodiment, it will be understood by those skilled in the art that various changes may be made and equivalents may be substituted for elements of the preferred embodiment without departing from invention. For example, the brace may consist of two members instead of three with one member slidably engaging the other member. In addition, many modifications may be made to adapt a particular situation and material to a teaching of the invention without departing from the essential teachings of the present invention.

As is evident from the foregoing description, certain aspects of the invention are not limited to the particular details of the examples illustrated, and it is therefore contemplated that other modifications and applications will occur to those skilled the art. For example, the brace may be attached to the bottom portion of the ladder as well as the top portion. It is accordingly intended that the claims shall cover all such modifications and applications as do not depart from the true spirit and scope of the invention.

I claim:

1. An attachment for a ladder having first and second siderails, comprising:

an elongated bar having first and second end portions and a middle portion extending between said end portions, said first and second end portions angularly extending from said middle portion;

a first U-bolt having a size sufficient for encircling said first siderail and attaching said middle portion of said elongated bar to said first siderail, and a second U-bolt having a size sufficient for encircling said second siderail and attaching said middle portion of said elongated bar to said second siderail;

a first extension member connected to said first end portion of said bar;

a first end plug fitted in and connected to said first extension member;

a second extension member connected to said second end portion of said bar;

a second end plug fitted in and connected to said second extension member;

a first resilient pad;

first means for pivotally connecting said first resilient pad to said first end plug;

a second resilient pad; and second means for pivotally connecting said second resilient pad to said second end plug.

* * * * *